United States Patent [19]

Griffith

[11] Patent Number: 4,715,410

[45] Date of Patent: Dec. 29, 1987

[54] WEAVING LOOM

[75] Inventor: John D. Griffith, Cleadon, England

[73] Assignee: Sulzer Brothers Limited, Winterthur, Switzerland

[21] Appl. No.: 908,044

[22] Filed: Sep. 16, 1986

[51] Int. Cl.[4] ..... D03D 47/48

[52] U.S. Cl. ..... 139/434

[58] Field of Search ..... 139/430, 434

[56] References Cited

U.S. PATENT DOCUMENTS

| | | | |
|---|---|---|---|
| 2,267,287 | 12/1941 | Moessinger | 139/434 |
| 2,839,090 | 6/1958 | Webber et al. | 139/434 |
| 3,153,430 | 10/1964 | Kundrach et al. | 139/434 |
| 3,232,320 | 2/1966 | Eilhauer | 139/434 |
| 3,424,207 | 1/1969 | Krebs | 139/434 |

FOREIGN PATENT DOCUMENTS

| | | | |
|---|---|---|---|
| 2141808 | 1/1973 | France | 139/434 |
| 83/02466 | 7/1983 | PCT Int'l Appl. . | |
| 8505384 | 12/1985 | PCT Int'l Appl. | 139/434 |
| 543398 | 2/1942 | United Kingdom . | |

*Primary Examiner*—Philip R. Coe
*Assistant Examiner*—Joseph S. Machuga
*Attorney, Agent, or Firm*—Bell, Seltzer, Park & Gibson

[57] ABSTRACT

Apparatus for turning the end of a weft yarn into a warp shed for creation of a selvedge, the apparatus including a movable guide which in a first position is located outside the warp sheet to receive the end of a weft yarn after weft insertion, and which is movable to a second position located within the warp shed whereby the guide serves to separate the end of the weft yarn from the warp threads. A fluid jet nozzle is associated with the guide and is positioned to direct a flow of fluid along the guide, after the guide is moved inwardly to the second position, for carrying the end of the weft yarn into the warp shed.

5 Claims, 4 Drawing Figures

WEAVING LOOM

FIELD OF THE INVENTION

The present invention relates generally to apparatus for use in a weaving loom for turning weft thread ends into the shed to create a selvedge, and to a weaving loom including the apparatus. In particular, the present invention is suitable for use with a fluid jet loom for creating a selvedge at the side of the warp sheet opposite to that at which weft insertion takes place.

BACKGROUND OF THE INVENTION

Turning-in of weft thread ends is known as a technique for creating a selvedge and is achieved by either using a needle which engages the weft thread end and positions it within the shed prior to beat-up or using several jet nozzles as demonstrated in U.K. Pat. No. 543,398 for blowing the weft thread end into the shed prior to beat-up. Both of these modes of operation have drawbacks and are unsuitable particularly at high pick rates.

For instance, the first mode of operation requires precision in construction and setting up in order to ensure that the needle correctly engages with the weft thread end. Additionally, since the needle penetrates into the shed it must be removed before beat-up can be completed. Accordingly, immediately before beat-up the weft thread end is unsupported and so is unable to relax thereby creating a loose selvedge which is unsatisfactory.

With regard to the second mode of operation the end of the weft thread is inserted by stream of air flowing from jet nozzles and has the tendency to snag against the warp threads. This tendency obviously increases if the weft thread and/or warp threads are of a hairy character. Accordingly, correct turning-in is not consistently assured and so can result in an irregular selvedge. Additionally, use of several jet nozzles necessitates a high consumption of pressurized air.

SUMMARY OF THE INVENTION

It is a general object of the present invention to provide an apparatus for turning-in the end of the weft threads which overcomes or substantially eliminates the drawbacks referred to above.

According to one aspect of the present invention, there is provided apparatus for turning the end of a weft yarn into a warp shed for creation of a selvedge, the apparatus including a movable guide which in a first position is located outside the warp sheet to receive the end of a weft yarn after weft insertion, and whichis movable to a second position located within the warp shed whereby the guide serves to separate the end of the weft yarn from the warp threads. A nozzle is associated with the guide and is positioned to direct a flow of fluid along the guide for carrying the weft yarn end into the warp shed.

Preferably the movable guide includes a pair of arms, or upper and lower plate members spaced apart to define a gap for receiving the end of the weft yarn and for guiding the flow of fluid therealong for carrying the weft yarn end into the warp shed.

According to another aspect of the present invention, there is provided a method of turning the end of a weft yarn into a warp shed for creation of a selvedge, the method including receiving the weft yarn end protruding from the warp sheet in a movable guide, after beat-up moving the guide into the newly formed shed to provide a passageway for the weft yarn end, directing a flow of fluid along the passageway to move the end of the weft yarn into the shed, and removing the guide from the shed while maintaining the flow of fluid for maintaining the weft yarn end in position until beat-up of the subsequently inserted weft yarn.

BRIEF DESCRIPTION OF THE DRAWINGS

Various aspects of the present invention are hereinafter described with reference to the accompanying drawings, in which.

DESCRIPTION OF THE ILLUSTRATED EMBODIMENT

An apparatus according to the present invention is generally shown at 10 and includes a guide member 12 and associated fluid jet nozzle 14, the fluid usually being compressed air. The jet nozzle 14 is aligned substantially in line with the fell position and is positioned to one side of the warp sheet 18 for directing a stream of air into the shed in a direction opposite to the direction of weft insertion.

Figure 4:
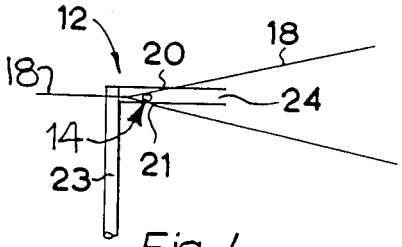
FIG. 4 is a schematic elevational view of the apparatus shown in FIG. 1.

The guide member 12 is generally positioned between the jet nozzle 14 and the adjacent side of the warp sheet 18. The guide member 12 includes a pair of arms or respective upper and lower plate members 20, 21 (FIG. 4) which are mounted on the upper end of a rotary shaft 23 so as to be spaced apart to define a gap 24 therebetween. The arms 20, 21 are conveniently formed from a thin gauge strip of metal or similar material.

Figure 1:
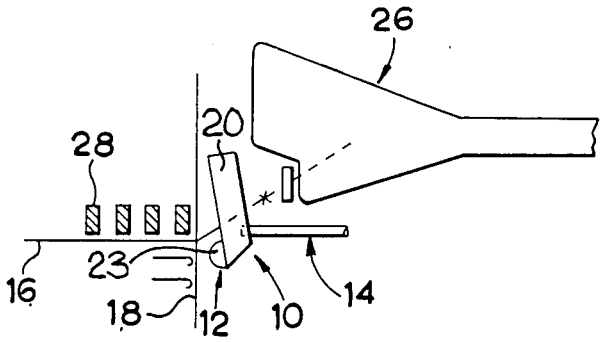
FIG. 1 is a schematic plan view illustrating an apparatus according to the present invention shown in situ on a loom which has just completed beat-up.
Figure 2:
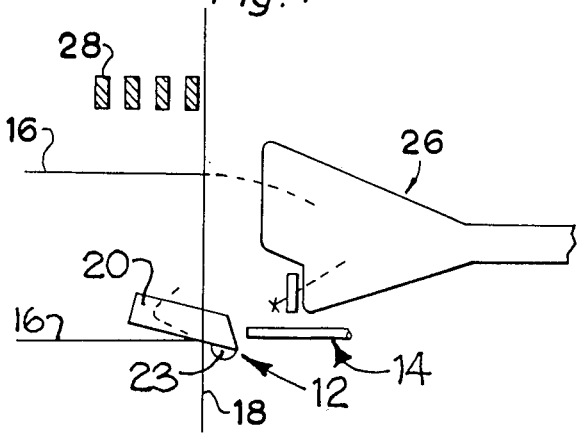
FIGS. 2 and 3 are views similar to FIG. 1 showing progressive stages of the turning-in process of the weft yarn end.
Figure 3:
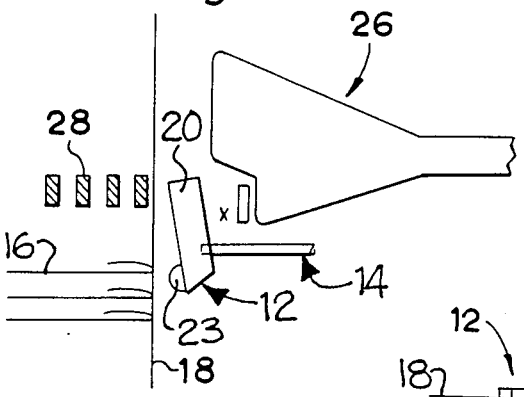

The guide member 12 is movable between first and second positions. In the first position (FIG. 1), it is located so that it is able to receive the end of a weft yarn 16 within the gap 24 after the weft yarn 16 has been fed across the warp shed 18. This may be achieved by positioning the guide member 12 so that in its first position the gap 24 is aligned with the path of weft insertion so that weft yarn 16 passes through the gap 24 as the end of the weft yarn 16 passes beyond the warp sheet 18 at termination of the weft insertion cycle. Alternatively, as per the illustrated embodiment, the guide member 12 may be positioned adjacent a conventional type of weft yarn end holding device 26, as for instance described in our European Patent Application No. 83900427 (Publication No. 0 098 856). In such an arrangement, the guide 12 is positioned downstream of the path of weft insertion so that the protruding end of the weft yarn 16 is moved into and through the gap 24 during beat-up as illustrated in FIG. 1. After beat-up, the reed, illustrated at 28, is retracted and shaft 23 is rotated to move the guide member 12 to its second position whereat it is located within the newly created shed as close as possible to the fell of the shed. This second position is illustrated in FIG. 2. In this position, the spaced-apart arms or plate members 20, 21 effectively define a passageway extending longitudinally of the fell and along which passageway the end of the weft yarn 16 may be moved inwardly without contacting the warp threads.

The jet nozzle 14 is positioned so as to direct its emitted flow into the gap 24, i.e. along the passageway so that its emitted air flow if guided between the arms or plate members 20, 21. This concentrates and regulates the air flow along and through the gap 24.

On actuation, after the guide 12 is moved inwardly to the second position shown in FIG. 2, the air flow from the jet nozzle 14 carries the end of the weft yarn 16 between the arms 20, 21 and into the warp shed. The weft yarn end during its passage into the warp shed is separated from the upper and lower warp threads by the respective upper and lower plate members 20, 21, and is so restrained from snagging on them.

After the end of the weft yarn 16 has been inserted into the warp shed, the arms 20, 21 are retracted back to their initial position to receive the next weft yarn end while the jet nozzle 14 continues to emit a flow of air into the warp shed, preferably until after beat-up.

In this way the end of the weft yarn 16 is maintained in position within the warp shed up to and during beat-up and so is correctly positioned and maintained under tension while beat-up occurs.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. Apparatus for turning a weft yarn into a warp shed for creating of a selvedge, the apparatus including a movable guide which in a first position is located outside the warm sheet to receive the end of the weft yarn after weft insertion, said guide being movable to a second position located within the warp shed so that said guide serves to separate the upper and lower warp threads adjacent the fell of the warp shed prior to turning in of the weft yarn end and to thereby prevent snagging of the end of the weft yarn on the upper and lower warp threads, and a fluid jet nozzle associated with said guide, said jet nozzle being positioned to direct a flow of fluid along said guide for carrying the end of the weft yarn into the warp shed and through said guide after said guide has moved to said second position.

2. Apparatus according to claim 1 wherein said movable guide includes a pair of upper and lower plate members spaced apart to define a gap therebetween for receiving the end of the weft yarn and for guiding the flow of fluid therealong for carrying the end of the weft yarn through the gap and into the warp shed.

3. Apparatus according to claim 2 wherein said movable guide is arranged so that in its first position said gap is aligned with the path of weft insertion so as to receive the end of the weft yarn.

4. Apparatus according to claim 1 including a weft yarn holding device located upstream of said guide for receiving the end of the weft yarn prior to beat-up.

5. A method of turning the end of a weft yarn into a warp shed for creation of a selvedge, the method including receiving the end of a weft yarn protruding from the warp sheet in a movable guide, after beat-up moving the guide into the newly formed warp shed to separate the upper and lower warp threads adjacent the fell of the warp shed prior to turning in of the weft yarn end and to thereby provide a passageway for the end of the weft yarn, directing a flow of fluid along the passageway to move the end of the weft yarn into the warp shed and through the passageway provided by the inwardly moved guide to prevent snagging of the end of the weft yarn on the upper and lower warp threads, removing the guide from the warp shed while maintaining said flow of fluid for maintaining the end of the weft yarn in position until beat-up of the subsequently inserted weft yarn.

* * * * *

UNITED STATES PATENT AND TRADEMARK OFFICE

CERTIFICATE OF CORRECTION

PATENT NO. : 4,715,410

DATED : December 29, 1987

INVENTOR(S) : John D. Griffith

It is certified that error appears in the above-identified patent and that said Letters Patent is hereby corrected as shown below:

Column 1, line 29, "unable" should be -- able --.

Column 1, line 52, "whichis" should be -- which is --.

Column 3, line 3, "if" should be -- is --.

Column 3, line 13, "is so" should be -- so is --.

Column 3, line 32, "creating" should be -- creation --.

Column 3, line 34, "warm" should be -- warp --.

Signed and Sealed this

Nineteenth Day of April, 1988

*Attest:*

*Attesting Officer*

DONALD J. QUIGG

*Commissioner of Patents and Trademarks*